US007578033B2

(12) United States Patent
Schlichter et al.

(10) Patent No.: US 7,578,033 B2
(45) Date of Patent: Aug. 25, 2009

(54) ROLLER FOR A FIBRE-PROCESSING MACHINE, FOR EXAMPLE A SPINNING PREPARATION MACHINE

(75) Inventors: Stefan Schlichter, Viersen (DE); Ulrich Vollrath, Neuss (DE)

(73) Assignee: Truetzschier GmbH & Co. KG, Moenchengladbach (DE)

( * ) Notice: Subject to any disclaimer, the term of this patent is extended or adjusted under 35 U.S.C. 154(b) by 826 days.

(21) Appl. No.: 11/176,376

(22) Filed: Jul. 8, 2005

(65) Prior Publication Data

US 2006/0019809 A1 Jan. 26, 2006

(30) Foreign Application Priority Data

Jul. 23, 2004 (DE) ..... 10 2004 035 770

(51) Int. Cl.
*D01G 15/00* (2006.01)

(52) U.S. Cl. ..... 19/98

(58) Field of Classification Search ..... 19/98; 492/50, 56

See application file for complete search history.

(56) References Cited

U.S. PATENT DOCUMENTS 6,219,885 B1 4/2001 Faas et al.
6,379,290 B1 * 4/2002 Sohl ..... 492/56
2005/0015988 A1 * 1/2005 Murakami et al. ..... 29/895.211

FOREIGN PATENT DOCUMENTS

| | | | |
|---|---|---|---|
| DE | 1037332 | | 8/1958 |
| DE | 195 33 823 | A1 | 9/1995 |
| DE | 41 28 428 | C2 | 7/1996 |
| DE | 695 30 126 | T2 | 6/1997 |
| DE | 101 18 854 | A1 | 4/2001 |
| DE | 10058272 | | 5/2002 |
| EP | 0 894 876 | A1 | 2/1999 |
| EP | 0 866 153 | A1 | 9/2001 |
| FR | 2 816 998 | A1 | 5/2002 |
| JP | 57-146912 | A | 9/1982 |
| WO | WO 03031160 | A1 * | 4/2003 |

OTHER PUBLICATIONS

Machine Translation of DE 4128428 A1.*
Search Report Dated Nov. 30, 2006 from FR 05 07815.

* cited by examiner

*Primary Examiner*—Shaun R Hurley
(74) *Attorney, Agent, or Firm*—Venable LLP; Robert Kinberg; Leigh D. Thelen

(57) ABSTRACT

A roller for a fibre-processing machine, for example a spinning preparation machine such as a flat card, cleaner or the like, flock feeder, roller card, nonwoven-forming machine or the like, comprises a roller body. In order to make possible, by simple means, economical manufacture and adequate dimensional stability, for example a substantially constant carding nip, the roller body has at least one metal cylinder and at least one circular cylindrical sheath of fibre-reinforced plastics material surrounding the cylinder.

30 Claims, 8 Drawing Sheets

II - II

I - I

ROLLER FOR A FIBRE-PROCESSING MACHINE, FOR EXAMPLE A SPINNING PREPARATION MACHINE

CROSS REFERENCE TO RELATED APPLICATION

This application claims priority from German Patent Application No. 10 2004 035 770.6 dated Jul. 23, 2004, the entire disclosure of which is incorporated herein by reference.

BACKGROUND OF THE INVENTION

The invention relates to a roller for a fibre processing machine, for example a spinning preparation machine such as a flat card, cleaner or the like, flock feeder, roller card, non-woven-forming machine or the like, having a wall of fibre-reinforced plastics material.

The effective spacing of the tips of a clothing from a machine element located opposite the clothing is called a carding nip. The said machine element can also have a clothing but could, instead, be formed by an encasing segment having a guide surface. The carding nip is decisive for the carding quality. The size (width) of the carding nip is a fundamental machine parameter, which influences both the technology (the fibre processing) and also the running characteristics of the machine. The carding nip is set as narrow as is possible (it is measured in tenths of a millimetre) without running the risk of a "collision" between the work elements. In order to ensure that the fibres are processed evenly, the nip must be as uniform as possible over the entire working width of the machine.

The carding nip is especially influenced, on the one hand, by the machine settings and, on the other hand, by the condition of the clothing. The most important carding nip in a carding machine having a revolving card top is located in the main carding zone, that is to say between the cylinder and the revolving card top unit. At least one of the clothings bounding the work spacing is in motion, usually both. In order to increase the production of the carding machine, endeavours are made to make the speed of rotation or velocity of the moving elements, in use, as high as fibre processing technology will allow. The work spacing changes as a function of the operational conditions, the change occurring in the radial direction (starting from the axis of rotation) of the cylinder.

In carding, larger amounts of fibre material are increasingly being processed per unit time, which results in higher speeds for the work elements and higher installed capacities. Increasing fibre material throughflow (production) leads to increased generation of heat as a result of the mechanical work, even when the work surface remains constant. At the same time, however, the technological result of carding (web uniformity, degree of cleaning, reduction of neps etc.) is being continually improved, leading to more work surfaces in carding engagement and to closer settings of those work surfaces with respect to the cylinder (drum). The proportion of synthetic fibres being processed is continually increasing, with more heat, compared with cotton, being produced as a result of friction from contact with the work surfaces of the machine. The work elements of high-performance carding machines today are fully enclosed on all sides in order to meet the high safety standards, to prevent emission of particles into the spinning room environment and to minimise the maintenance requirement of the machines. Gratings or even open material-guiding surfaces, which allow an exchange of air, belong to the past. As a result of the circumstances mentioned, there is a marked increase in the input of heat into the machine whereas there is a marked decrease in the heat removed by means of convection. The resulting increase in the heating of high-performance carding machines results in greater thermoelastic deformations, which, because of the unequal temperature field distribution, influence the set spacings of the work surfaces: the spacings between the cylinder and the card top, doffer, fixed card tops and separating-off locations decrease. In extreme cases, the nip set between the work surfaces can be completely used up as a result of thermal expansion so that components in relative motion collide, causing major damage to the high-performance carding machine concerned. Additionally, it is especially possible for the generation of heat in the work region of the carding machine to result in different thermal expansions when the temperature differences between the components are too large.

In a known roller of fibre-reinforced plastics material for a carding machine (EP 0 894 876 A), the reinforcing fibres are present in the form of an arrangement extending at least in part in the circumferential direction. The roller has a cylinder wall and cylinder ends made of fibre-reinforced plastics material. In order to achieve adequate stability, the roller must have a wall thickness (cylinder wall) of at least 10 mm—preferably at least 15 mm—that is uniform over its length. A winding method is employed, wherein fibres soaked with resin are wound around a shaping core which is removed from the end product. A disadvantage is the high cost both for manufacture and also for the fibre-reinforced plastics material for the thick cylinder wall. The cost for manufacture of the cylinder ends is also considerable. In addition, it is disadvantageous that, in the case of high-speed rollers for fibre-processing machines provided with clothings, the loading circumstances and operating conditions are difficult to master (constant carding nip) so that no rollers made from fibre-reinforced plastics material have been used hitherto for fibre-processing machines provided with clothings. A further disadvantage is that fibre-reinforced plastics material is poorly suited for the cylinder ends and the entire internal and hub regions.

It is an aim of the invention to provide an apparatus of the kind mentioned at the beginning that avoids or mitigates the mentioned disadvantages and that especially makes possible, by simple means, economical manufacture and adequate dimensional stability in use, namely a substantially constant carding nip.

SUMMARY OF THE INVENTION

The invention provides a roller for a fibre-processing machine, having a roller body comprising:

- at least one metal cylinder; and
- at least one sheath of fibre-reinforced plastics material surrounding the cylinder.

The roller according to the invention consists of at least one metal cylinder and an outer ring of hardened fibre-reinforced plastics material. The metal cylinder gives the roller the requisite rigidity and strength. This applies both to the roller wall and to the cylinder ends. As a result of the fact that the wall is surrounded by a sheath of fibre-reinforced plastics material, the thickness (amount) of the sheath can be kept small, which makes possible economical manufacture. Such a sheath limits or avoids (compensates) widening of the cylinder in use due to heat and/or centrifugal force so that, in advantageous and simple manner, the carding nip between the roller clothing and the clothing of a machine element located opposite, for example a revolving or stationary card top, remains substantially or entirely constant. Further advantages in use are, for example, substantially improved braking values, savings in terms of drive units, energy savings, higher production rates, wider working widths and vibration-free running.

Advantageously, the metal cylinder and the sheath are mutually biased at room temperature and at operating temperature. Preferably, the metal cylinder is subjected to compressive stresses and the sheath is subjected to tensile stresses in the circumferential direction. Advantageously, the cylinder is made, at least in part, of steel. Steel ensures the stability of the cylinder and has relatively high resistance to bending. Preferably, the cylinder is made, at least in part, of aluminium. Aluminium likewise ensures the stability of the cylinder and has a relatively low specific weight. Preferably, the sheath is made of carbon fibre reinforced plastics material (CFRP). Carbon has a density of 1.45 g/cm$^3$. The basic material comprises carbon fibres. The latter can be produced from plastics filaments, which are heated in the absence of air and consequently "carbonised". For example, they have a diameter of 0.007 mm. These fibres are embedded in a carrier substance (matrix) of synthetic resins. The forces acting on carbon fibres are taken up by the fibres substantially only in the line of force flux. The fibres are therefore mainly laid in parallel. If bending and torsional stresses do not come from just one direction, individual layers of fibres are advantageously placed on top of one another in different orientations. Preferably, the thermal expansion coefficient of the carbon fibre reinforced plastics material (CFRP) is adjustable. Zero adjustment means no change and negative adjustment results in contraction so that no thermal expansion or negative thermal expansion of the component(s) is produced. By that means, the materials of the cylinder and, for example, the side parts are so matched to one another that, under the heat acting on the parts influencing the carding nip in use, the carding nip remains constant. Preferably, the sheath is made of glass fibre reinforced plastics material (GFRP). Advantageously, the sheath is made of aramid fibre reinforced plastics material (AFRP). Preferably, a mixture of fibres is used, for example of carbon fibres and glass fibres. Advantageously, the reinforcement fibres in the sheath are oriented substantially in the circumferential direction of the cylinder. As a result, widening of the cylinder as a result of centrifugal force is especially advantageously reduced or avoided, especially at high speeds of rotation. Advantageously, the cylinder is enclosed. Preferably, the removal of heat from the cylinder is different to that from the side parts. Advantageously, the reinforcement fibres and the matrix material together result in a modulus of elasticity of at least 15000 N/mm$^2$. Preferably, the fibre strands (reinforcement fibres) form an included angle ($\alpha$) of ±75° to 90° with the axial direction of the roller body. Advantageously, the fibre strands (reinforcement fibres) form an included angle ($\alpha$) of 35° to 75° with the axial direction of the roller body. Preferably, the fibre strands (reinforcement fibres) form an included angle ($\alpha$) of 1° to 35° with the axial direction of the roller body. Advantageously, at least two different angles are provided for the fibre strands. Preferably, at least two sheaths are arranged on top of one another in the radial direction. Advantageously, the fibre strands of at least one sheath have a steep angle ($\alpha$), for example ±75° to 90°, and the fibre strands of at least one further sheath have a shallow angle ($\alpha$), for example 1° to 35°. Preferably, the expansion coefficient in the axial direction of at least one sheath is equal to or less than the expansion coefficient in the axial direction of at least one further sheath. Advantageously, the expansion coefficient in the circumferential direction of at least one sheath is equal to or greater than the expansion coefficient in the circumferential direction of at least one further sheath. Preferably the linear expansion coefficient in the circumferential direction and in the axial direction is less than $8\times10^{-6}$ (1/° K.). Advantageously, the fibre strands are arranged next to one another in the circumferential direction. Preferaby, the layers of fibre strands that follow one another in the radial direction cross over one another. Advantageously, a clothing, for example a sawtooth clothing, is drawn onto the sheath. Preferably, means are provided in order to be able to earth a clothing drawn onto the roller. Advantageously, that part of the roller which accommodates the clothing is in the form of a cylindrical element (without significant changes in cross-section). Preferably, the roller has a wall thickness that is uniform over its length. Advantageously, the roller consists of a cylindrical part and end parts, the expansion behaviour of the end parts being matched to the expansion behaviour of the cylindrical part. Preferably, the outer layer of the part accommodating the clothing is formed of matrix material. Advantageously, a clothing is drawn onto the roller in such a manner that, at a given operating speed of rotation, the pressure brought about by the drawing-on of the clothing and the tensile force produced by the centrifugal force can be substantially balanced in the material of the roller. Preferably, there is drawn onto the roller a clothing of such a kind that, at a given operating speed of rotation, the clothing cannot be detached from the surface of the roller accommodating it. Advantageously, the clothing is formed by a wire drawn onto the cylindrical roller surface, a drawing-on force of not more than 40 N being used. Preferably, the working width of the roller measures more than 1000 mm, for example 1500 mm. Advantageously, feed and offtake means co-operate with this roller directly. Preferably, the roller drive system is dimensioned for high speeds of rotation in order to make possible a circumferential speed of at least 40 m/s. Advantageously, the roller has a clothing having a tip density of more than 900 tips per square inch. Preferably, stationary card tops are associated with the roller. Advantageously, the roller is part of a flat card or roller card. Preferably, revolving card tops are associated with the roller. Advantageously, stationary carding elements are associated with the roller. Preferably, the roller is the cylinder of a flat card or roller card. Advantageously, the roller is the feed roller of a flat card or roller card. Preferably, the roller is a licker-in of a flat card or roller card. Advantageously, the roller is the doffer of a flat card or roller card. Preferably, the roller is the stripper roller of a flat card or roller card. Advantageously, the roller is the worker of a roller card. Preferably, the roller is the clearer of a roller card. Advantageously, the roller is the opener roller of a flock-feeding apparatus. Preferably, the roller is part of an opener or cleaner. Advantageously, the roller is part of a draw frame. Preferably, the roller forms a drawing mechanism roller. Advantageously, the roller is associated, as an opener roller, with a flock-mixing device. Preferably, the roller is associated, as an opener roller, with a flock intake device. Advantageously, the roller is associated, as an opener roller, with a bale opener. Preferably, the roller has a tubular roller body supported on mounting shafts at the ends. Advantageously, the roller has at least two cylinder ends.

The invention provides a roller for a fibre-processing machine, for example a spinning preparation machine such as a flat card, cleaner or the like, flock feeder, roller card, non-woven-forming machine or the like, having a wall of fibre-reinforced plastics material, wherein the roller has at least one metal cylinder and at least one circular cylindrical sheath of fibre-reinforced plastics material surrounding the cylinder.

DETAILED DESCRIPTION OF PREFERRED EMBODIMENTS

Figure 1:
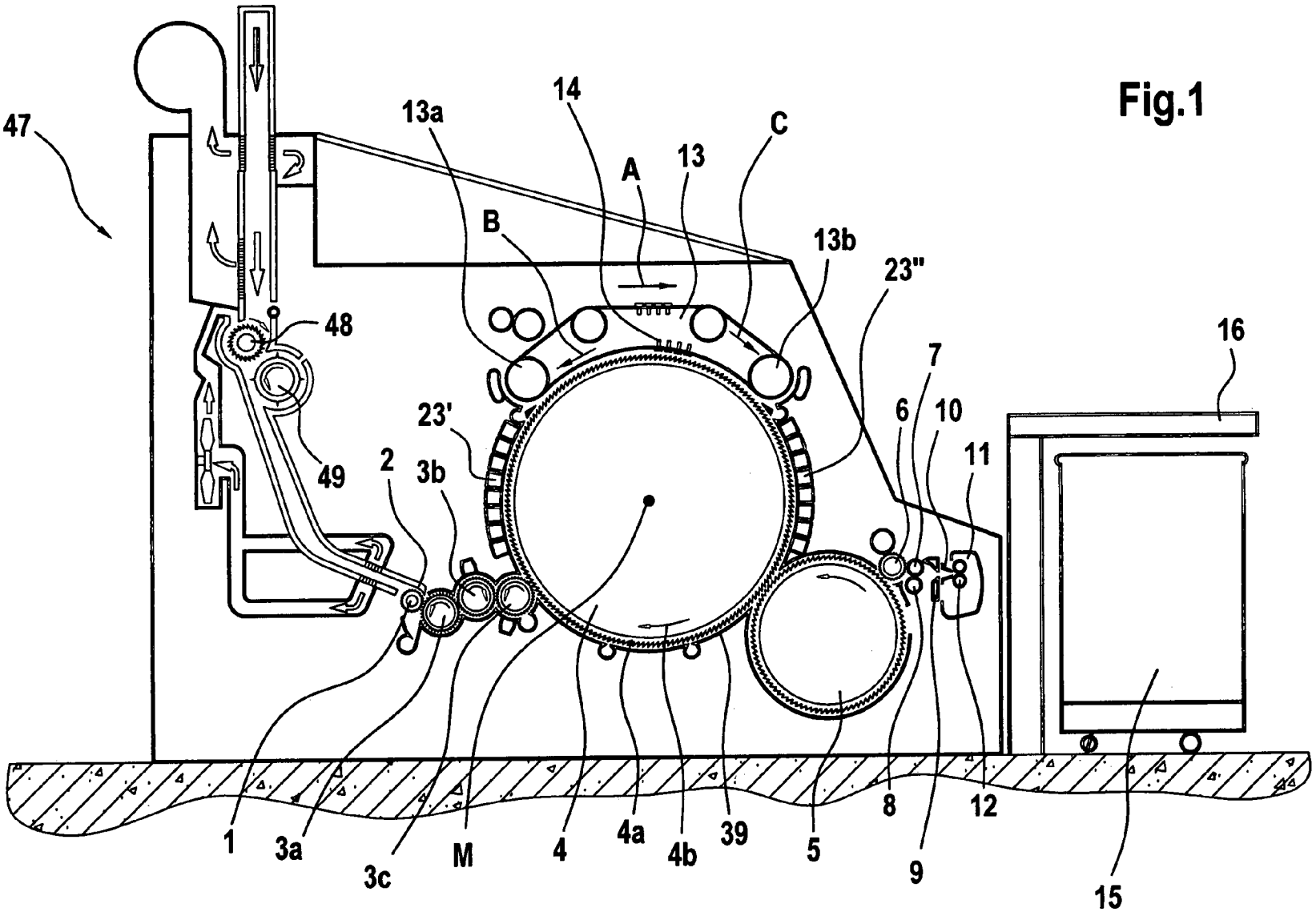
FIG. 1 is a diagrammatic side view of a flat card with the roller according to the invention.

With reference to FIG. 1, a flat card, for example a TC 03 (Trademark) flat card made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter B denotes the direction of rotation of the revolving card top 13 at the carding location and reference letter C denotes the direction in which the card top bars 14 are moved on the reverse side. Reference numerals 23', 23" denote stationary carding elements and reference numeral 39 denotes a cover underneath the cylinder 4. Arrow A denotes the work direction.

Figure 2:
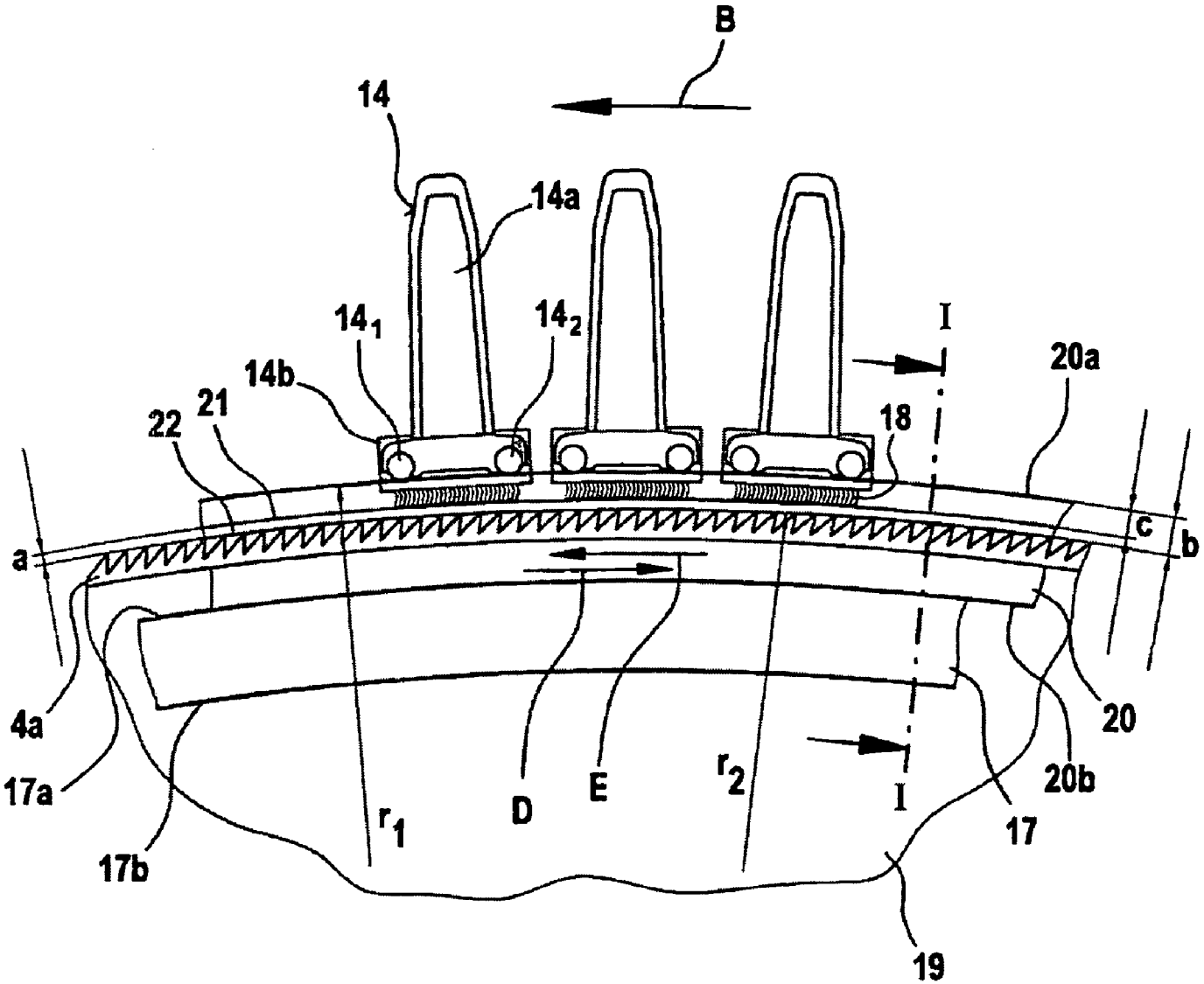
FIG. 2 shows card top bars of the revolving card top and portions of a slideway, of the flexible bend, of the side screen and of the cylinder, and also the carding nip between the clothings of the card top bars and the cylinder clothing.
Figure 4:
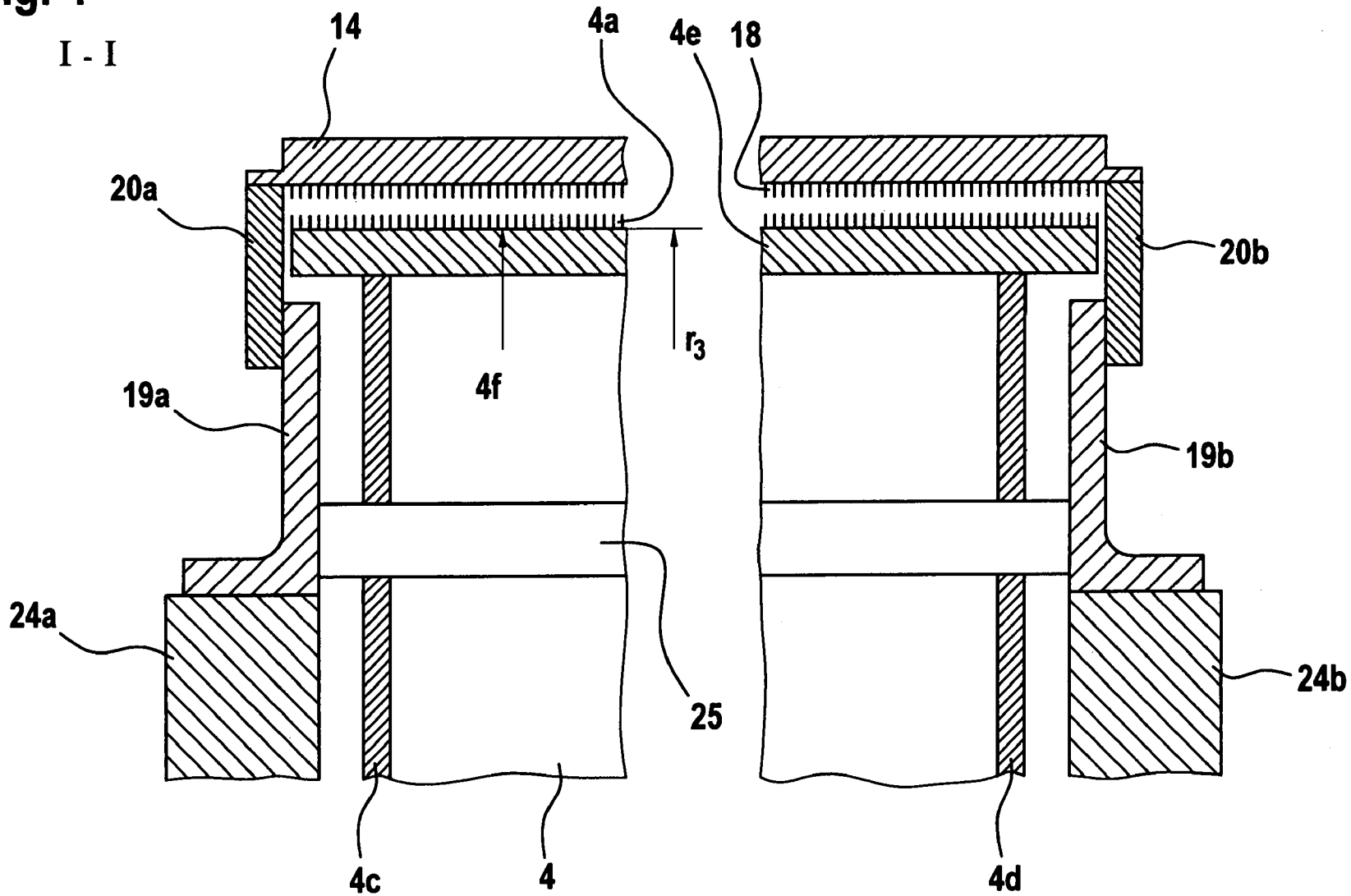
FIG. 4 shows, in a diagrammatic section I-I, the slideway according to FIG. 2 together with the cylinder, card tops, flexible bends and side screens.

Referring to FIG. 2, on each side of the flat card, a flexible bend 17 having several adjustment screws is fixed laterally to the side screen 19*a*, 19*b* (see FIG. 4). The flexible bend 17 has a convex outer surface 17*a* and an underside 17*b*. On top of the flexible bend 17 there is a slideway 20, for example made of low-friction plastics material, which has a convex outer surface 20*a* and a concave inner surface 20*b*. The concave inner surface 20*b* rests on top of the convex outer surface 17*a* and is able to slide thereon in the direction of arrows D, E. Each card top bar 14 consists of a rear part 14*a* and a carrying member 14*b*. Each card top bar 14 has, at each of its two ends, a card top head, each of which comprises two steel pins $\mathbf{14}_1$, $\mathbf{14}_2$. Those portions of the steel pins $\mathbf{14}_1$, $\mathbf{14}_2$ that extend out beyond the end faces of the carrying member 14*b* slide on the convex outer surface 20*a* of the slideway 20 in the direction of the arrow B. A clothing 18 is attached to the underside of the carrying member 14*b*. Reference numeral 21 denotes the circle of tips of the card top clothings 18. The cylinder 4 has on its circumference a cylinder clothing 4*a*, for example a sawtooth clothing. Reference numeral 22 denotes the circle of the tips of the cylinder clothing 4*a*. The spacing (carding nip) between the circle of tips 21 and the circle of tips 22 is denoted by reference letter a and is, for example, 3/1000". The spacing between the convex outer surface 20*a* and the circle of tips 22 is denoted by reference letter b. The spacing between the convex outer surface 20*a* and the circle of tips 21 is denoted by reference letter c. The radius of the convex outer surface 20*a* is denoted by reference letter $r_1$ and the radius of the circle of tips 22 is denoted by reference letter $r_2$. The radii $r_1$ and $r_2$ intersect at the centre point M of the cylinder 4. Reference numeral 19 denotes the side screen.

Figure 3A:
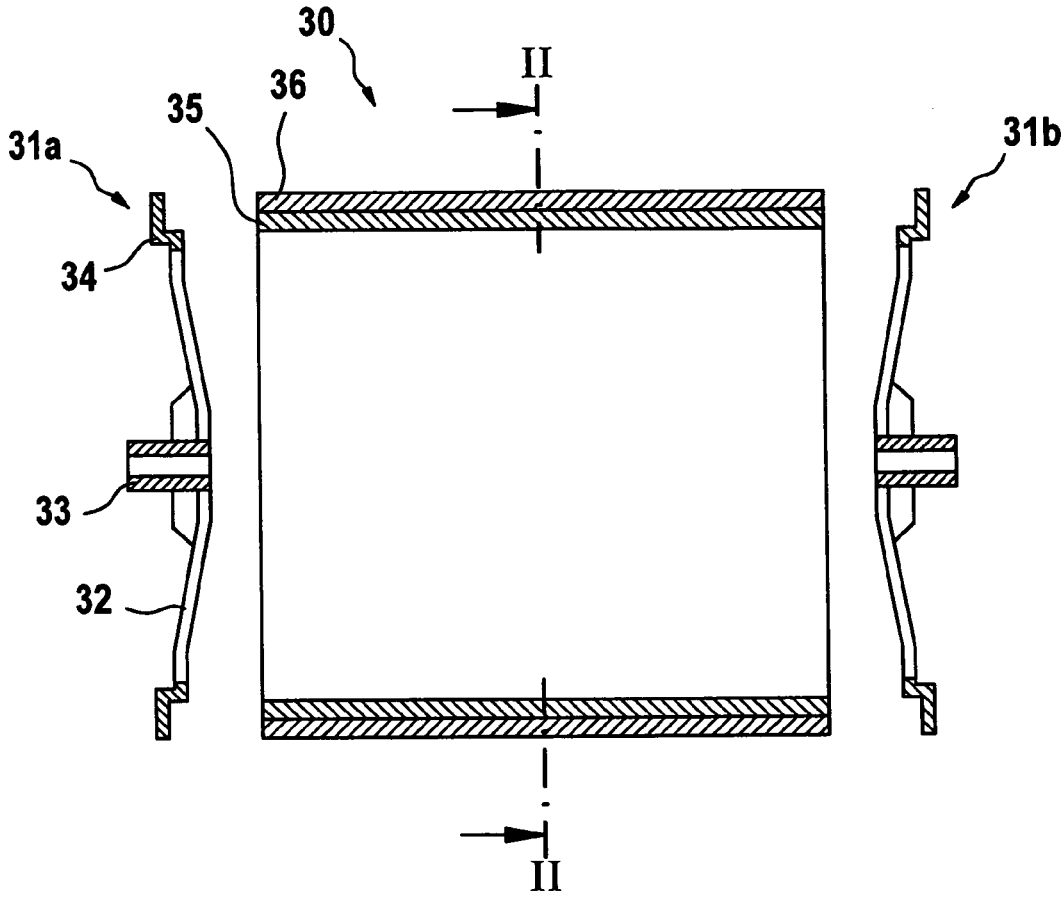
FIGS. 3*a*, 3*b* are sections through a roller comprising a metal cylinder and a circular cylindrical sheath made of carbon fibre reinforced plastics material surrounding the cylinder, in a front view (FIG. 3*a*) and side view (FIG. 3*b*)
Figure 3B:
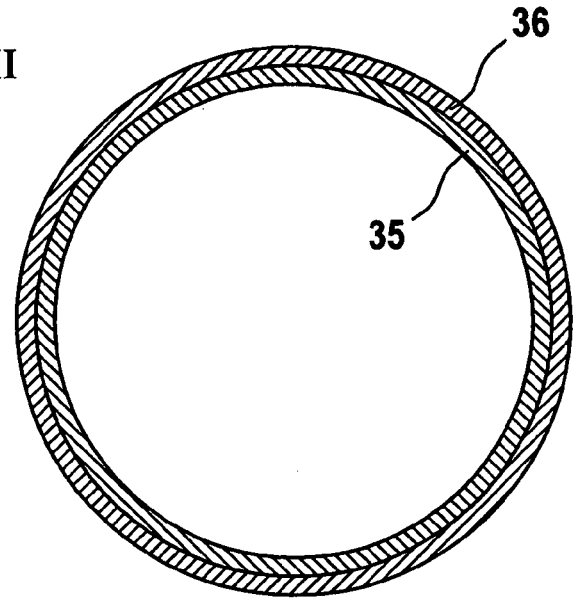

The high-speed roller shown in FIGS. 3*a*, 3*b* for a fibre-processing machine, for example a cylinder 4 of a flat card, consists of a hollow cylindrical roller body 30 and two roller ends 31*a*, 31*b* at the end faces. The roller ends 31*a*, 31*b* advantageously are made of metal, for example steel or aluminium. Reference numeral 32 denotes a spoke, reference numeral 33 a hub and reference numeral 34 an end flange. The roller body 30 consists of an internal steel cylinder 35 and an external hardened CFRP sheath 36. The CFRP sheath 36 has the shape of a thin-walled hollow cylinder. At operating temperature, in the biased state, compressive stresses are present in the circumferential direction in the wall region of the steel cylinder 35 and tensile stresses in the cylindrical CFRP sheath 36. In use, because of the centrifugal force to which the steel cylinder 35 is subjected, the compressive stresses are reduced. The thermal expansion coefficient of the cylinder material is much greater than the thermal expansion coefficient of the carbon fibre reinforced plastics material in the direction of the reinforcement fibres; for example, the thermal expansion coefficient $\alpha$ of steel is between $11\times10^{-6}$ $K^{-1}$ and $17\times10^{-6}$ $K^{-1}$ and that of CFRP in the fibre direction is about zero, especially between $-2\times10^{-6}$ $K^{-1}$ and $+2\times10^{-6}$ $K^{-1}$. When subjected to heat in use, the internal diameter of the CFRP sheath 36 changes only very slightly, whereas the thermal expansion of the steel cylinder 35 is considerable. The thermal expansion of the CFRP-sheathed steel cylinder 35 is consequently less than the thermal expansion of a cylinder having an all-steel wall.

The roller according to the invention, comprising a metal cylinder and a composite fibre sheath, especially a substantially circular cylindrical sheath, is lighter in comparison to an all-steel or all-aluminium roller, has a reduced mass inertia and exhibits linear thermal expansion which is adjustable (down to negative values) as a result of constructively arranged fibre orientation. The advantages of the roller according to the invention in use, which result from the properties of the material, are, for example, substantially improved braking values, savings in terms of drive units, energy savings, higher production rates, wider working widths and vibration-free running.

Density, specific rigidity and specific strength

The table that follows lists the density, modulus of elasticity and strength of the materials in comparison with one another:

| Material | Density ($g/cm^3$) | Modulus of elasticity ($N/mm^2$) | Strength (MPa) |
|---|---|---|---|
| St 52 | 7.8 | 210 000 | 400 |
| Al | 2.7 | 70 000 | 350 |
| CFRP | 1.3 | 75 000 to 180 000 | 1500 |
| GFRP | 1.9 | 20 000 to 40 000 | 1250 |

In the direction of the fibres, CFRP has considerable advantages compared to steel. The individual fibres made up into a tube in the course of a winding process determine the anisotropic (directionally dependent) behaviour of such a tube.

FIG. 4 shows part of the cylinder 4 together with the cylindrical surface 4*f* of its wall 4*e* and the cylinder ends 4*c*, 4*d* (radial supporting elements). The surface 4*f* is provided with a clothing 4*a*, which in this example is provided in the form of wire with sawteeth. The sawtooth wire is drawn onto the cylinder 4, that is to say is wound around the cylinder 4 in tightly adjacent turns between side flanges (not shown), in order to form a cylindrical work surface provided with tips. Fibres should be processed as evenly as possible on the work surface (clothing). The carding work is performed between the clothings 18 and 4*a* located opposite one another and is substantially influenced by the position of one clothing with respect to the other and by the clothing spacing a between the tips of the teeth of the two clothings 18 and 4*a*. The working width of the cylinder 4 is a determining factor for all other work elements of the flat card, especially for the revolving card tops 14 or stationary card tops 23', 23" (FIG. 1), which together with the cylinder 4 card the fibres evenly over the entire working width. In order to be able to perform even carding work over the entire working width, the settings of the work elements (including those of additional elements) must be maintained over that working width. The cylinder 4 itself can, however, be deformed as a result of the drawing-on of the clothing wire, as a result of centrifugal force or as a result of heat produced by the carding process. The shaft 25 of the cylinder 4 is mounted in positions (not shown) located on the stationary machine frame 24*a*, 24*b*. The diameter, for example 1250 mm, of the cylindrical surface 4*f*, that is to say twice the radius $r_3$, is an important dimension of the machine and becomes larger in use as a result of the heat of work. The side screens 19*a*, 19*b* are fastened to the two machine frames 24*a* and 24*b*, respectively. The flexible bends 17*a* and 17*b* are fastened to the side screens 19*a* and 19*b*, respectively.

When heat is produced in use in the carding nip a between the clothings 18 (or in the carding nip d between the clothings 23') and the cylinder clothing 4*a* as a result of carding work, especially in the case of a high production rate and/or the processing of synthetic fibres or of cotton/synthetic fibre blends, the cylinder wall 4*e* undergoes expansion, that is to say the radius $r_3$ increases and the carding nip a decreases. The heat is directed via the cylinder wall 4*e* into the radial carrying elements, the cylinder ends 4*c* and 4*d*. The cylinder ends 4*c*, 4*d* likewise undergo expansion as a result thereof, that is to say the radius increases. The cylinder 4 is almost entirely encased (enclosed) on all sides-in a radial direction by the elements 14, 23', 37 (see FIG. 1 and FIG. 5*a*) and to the two sides of the flat card by the elements 17*a*, 17*b*, 19*a*, 19*b*, 24*a*, 24*b*. As a result, scarcely any heat is radiated from the cylinder 4 to the outside (to the atmosphere). Nevertheless, the heat of the cylinder ends 4*c*, 4*d* of large surface area is especially conveyed by means of radiation to the side screens 19*a*, 19*b* of large surface area to a considerable extent, from where the heat is radiated out to the colder atmosphere. As a result of that radiation, the expansion of the side screens 19*a*, 19*b* is less than that of the cylinder ends 4*c*, 4*d*, which results in a reduction in the carding nip a (FIG. 2*a*) that ranges from undesirable (in terms of the result of carding) to hazardous. The carding elements (card top bars 14) are mounted on the flexible bends 17*a*, 17*b* and the fixed carding-elements 23', 23" are mounted on the extension bends, which are in turn fixed to the side screens 19*a*, 19*b*. In the event of heating, for example in the case of a cylinder 4 of steel and aluminium card top bases 14, the lifting of the flexible bends 17*a*, 17*b*-and, as a result, of the clothings 18 of the card top bars 14-increases less, compared to the expansion of the radius $r_3$ of the cylinder wall 4*e*-and, as a result, of the clothing 4*a* of the cylinder 4-, which results in narrowing of the carding nip a. The cylinder wall 4*e* and the cylinder ends 4*c*, 4*d* are made of steel, for example St 37, having a linear thermal expansion coefficient of $11.5\times10^{-6}$[1/° K.]. In order then to compensate for the relative differences in the expansion of the cylinder ends 4*c*, 4*d* and the cylinder wall 4*e*, on the one hand, and the side screens 19*a*, 19*b*, on the other hand (as a result of impeded radiation into the atmosphere because of encasing of the cylinder 4 and free radiation into the atmosphere from the side screens), the sheath 36 is made of carbon fibre reinforced plastics material (CFRP) whose thermal expansion coefficient has been negatively adjusted. By that means, the expansion of the cylinder 4 due to a lack of removal of heat as a result of encasing is reduced or avoided. As a result, undesirable reduction in the carding nip a due to thermal influences is avoided.

Figure 5A:
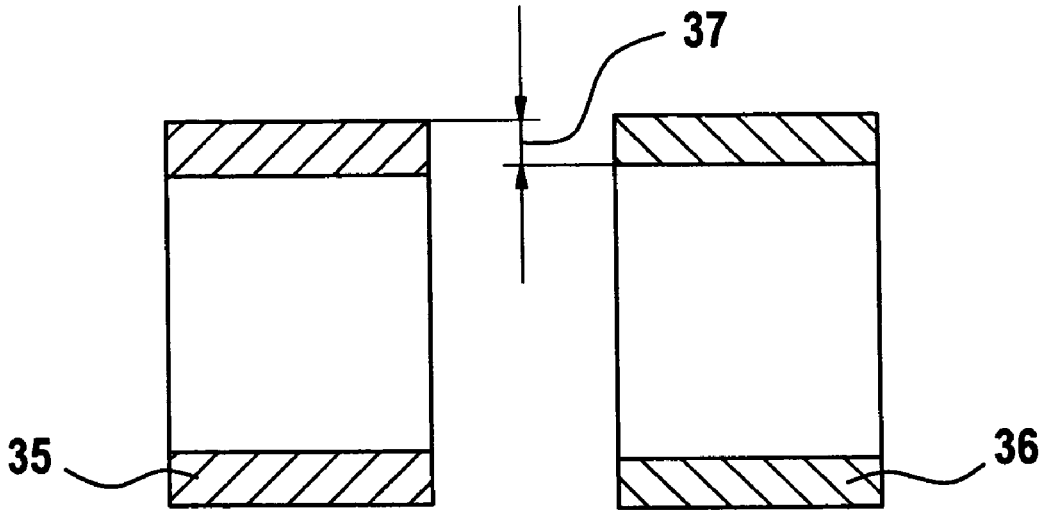
FIGS. 5*a*, 5*b* show, in diagrammatic form, two method steps in the manufacture of a biased roller, namely the steel cylinder and sheath at room temperature (FIG. 5*a*) and at joining temperature (FIG. 5*b*)
Figure 5B:
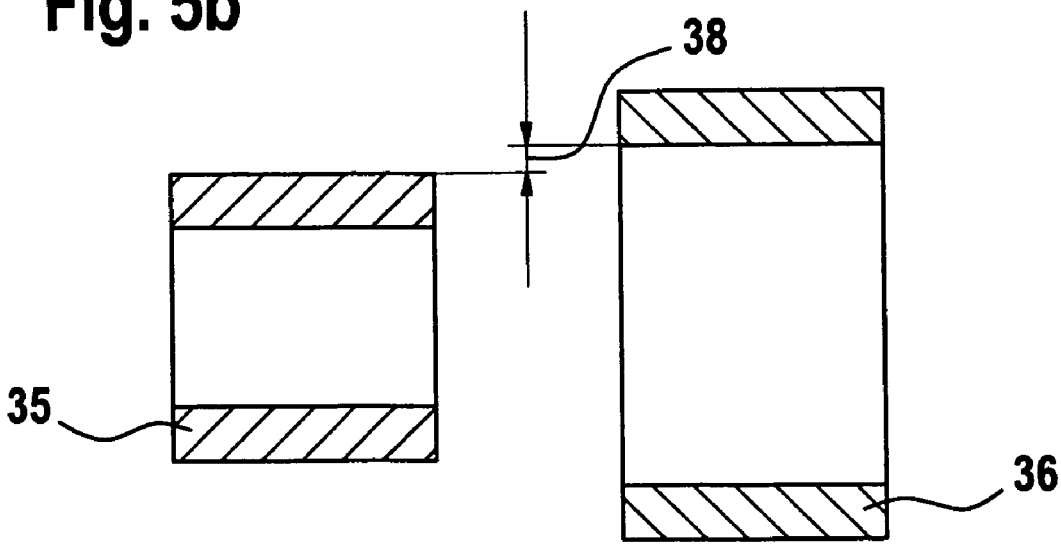

The biasing method is shown in diagrammatic form in FIGS. 5*a*, 5*b*. The steel cylinder body 35 and the hardened CFRP sheath 36 are shown in these Figures in simplified form as hollow cylinders. At room temperature, in accordance with FIG. 5*a*, the external diameter of the steel cylinder body 35 is larger than the internal diameter of the hardened CFRP sheath 36. The excess dimension 37 is calculated on the basis of the desired biasing force in the steel cylinder body 35 and the joining gap 38 required for joining in accordance with FIG. 5*b*. From those two variables and the thermal expansion coefficients of the steel cylinder body 35 and the CFRP sheath 36 there is derived the temperature difference necessary for biasing. FIG. 5*b* shows the geometric relationships in the cooled state, which corresponds to the joining state. The joining gap 38 must be so dimensioned that the two parts 35 and 36 can be readily inserted one inside the other. The joining temperature is lower than room temperature. After joining, the two parts 35 and 36 are slowly reheated, whereupon the desired biasing takes place. FIG. 3*a* shows a roller at room temperature or operating temperature, which can be biased, for example, in accordance with FIGS. 5*a*, 5*b*.

Figure 6:
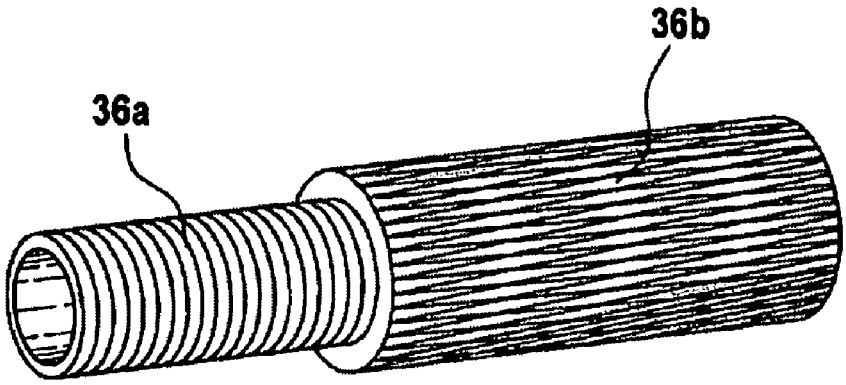
FIG. 6 shows the structure of a sheath of two layers arranged on top of one another with a part of the outer layer removed.

In accordance with FIG. 6, the pitches of the helical windings of the fibres ($\mathbf{36}_1$, see FIG. 7) in the inner sheath 36*a* and in the outer sheath 36*b* are different. The pitch is shown in diagrammatic form by a winding angle of $\alpha_1$ and $\alpha_2$ (see FIG. 7). The winding angle of the inner sheath 36*a* is small and is, for example, 85°. The resistance of the cylinder 4 to radial widening under the action of heat and centrifugal force is dependent upon the arrangement of the fibres: the smaller the angle, the higher the resistance. The winding angle of the outer sheath 36 is large and is, for example, 10°. The resistance of the cylinder 4 to sagging is likewise dependent on the arrangement of the fibres: the larger the angle, the lower the amount of sagging. The rollers of roller cards 51 and of roller card feeders 50 (FIG. 9) can have a length of 5 to 6 m, which requires a low degree of sagging. The combination of winding angles according to FIG. 6 brings about a high degree of resistance both to widening and also to sagging.

Figure 7:
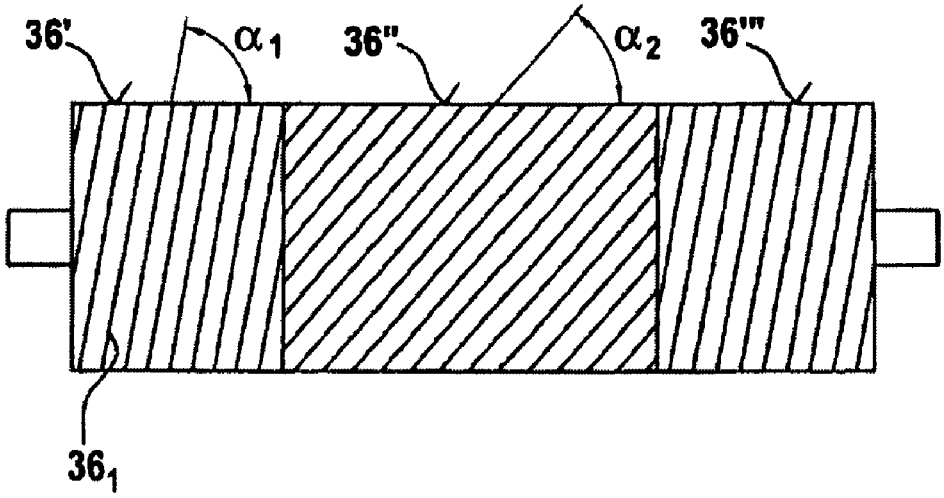
FIG. 7 shows the structure of a sheath of three parts arranged next to one another.

The affangement according to FIG. 7 is advantageous when different properties are required for the roller in the edge regions, on the one hand, and in the middle region, on the other hand. The winding angle is accordingly steeper in the edge regions 36' and 36'" than in the middle region 36". A single layer sheath having three regions arranged next to one another is shown.

Figure 8:
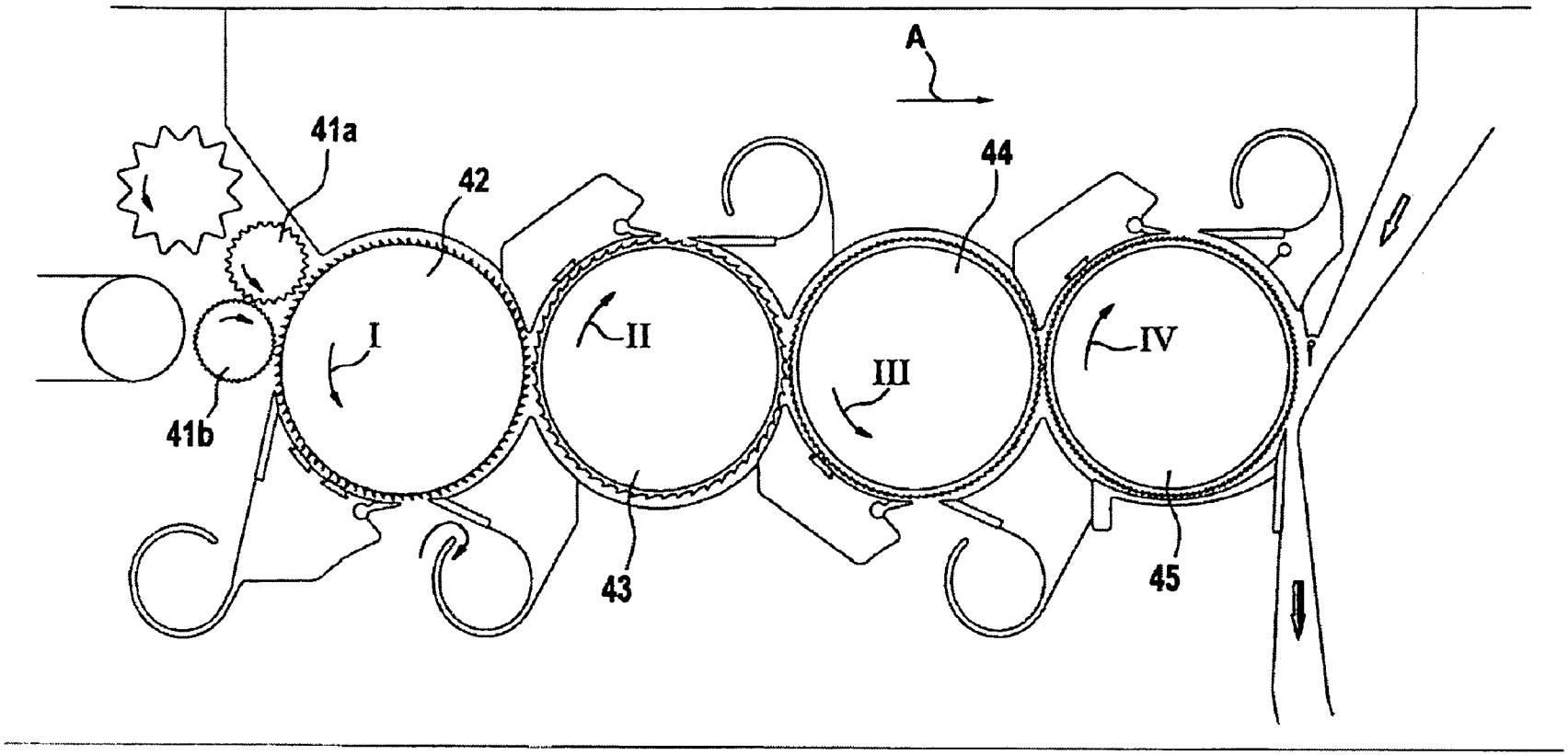
FIG. 8 is a diagrammatic side view of a cleaner with the roller according to the invention.

In accordance with FIG. 8, the fibre material (arrow) to be cleaned, which is especially cotton, is supplied in flock form to the cleaning apparatus arranged in an enclosed housing, for example a CL-C4 cleaning apparatus made by Trützschler GmbH & Co. KG. This is accomplished, for example, by a charging shaft (not shown), conveyor belt or the like. The material in wad form is supplied by two feed rollers 41*a*, 41*b*, with nipping therebetween, to a pin roller 42, which is rotatably mounted in the housing and which revolves in an anti-clockwise direction (arrow I). Downstream of the pin roller 42 is a clothed roller 43, which is provided with a sawtooth clothing. The roller 42 has a circumferential speed of about 10 to 21 m/sec. The roller 43 has a circumferential speed of about 15 to 25 m/sec. The roller 44 has a circumferential speed greater than that of the roller 43, and the roller 45 has a circumferential speed greater than that of the roller 44. Downstream of the roller 42 there is a succession of further sawtooth rollers 43, 44 and 45, the directions of rotation of which are indicated by reference numerals II, III and IV. The rollers 42 and 45 have a diameter of about from 150 to 300 mm. The rollers 42 to 45 are enclosed by the housing. Associated with the sawtooth roller 45 are a stationary carding element, an adjustment guiding element, an air flow aperture, a separating blade and a pressure-measuring element. Associated with the separating blade is a suction hood. Reference letter A denotes the working direction of the cleaner. The rollers according to the invention comprising a metal cylinder 35 and a circular cylindrical sheath 36 surrounding the cylinder are used for at least one of rollers 42 to 45. The cleaner can be constructed, for example, in accordance with DE-A-101 22 459.

Figure 9:
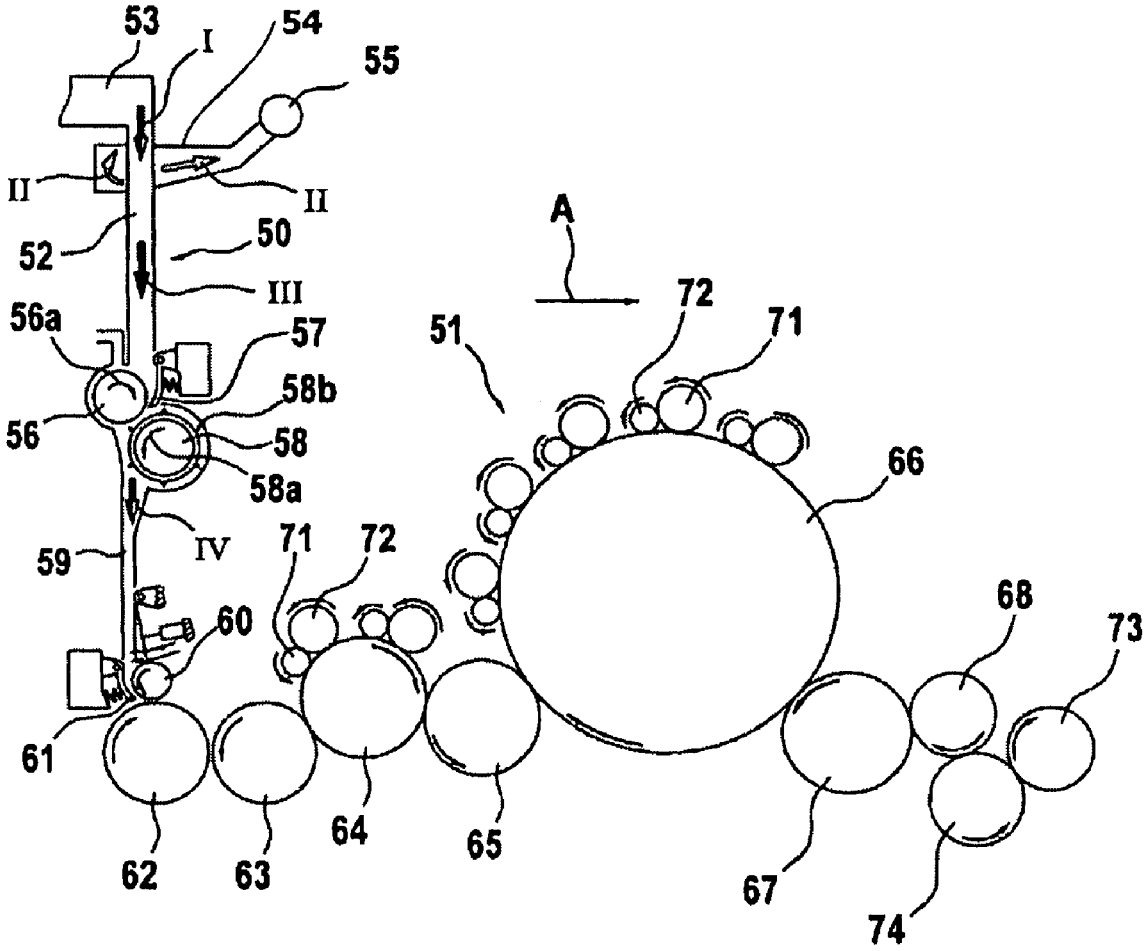
FIG. 9 is a diagrammatic side view of a roller card and roller card feeder with the rollers according to the invention.

In accordance with FIG. 9, a vertical reserve shaft 52 is provided upstream of a roller card 51, which shaft is fed from the top with finely dispersed fibre material I. Feeding can be accomplished, for example, by means of supply and distribution line 53 by way of a condenser. Provided in the upper region of the reserve shaft 52 are air outlet apertures 54, through which the transporting air II passes into a venting device 55 after separation from the fibre flocks III. The lower end of the reserve shaft 52 is closed by a feed roller 56 (intake roller), which co-operates with a feed trough 57. The slow-speed feed roller 56 supplies the fibre material III from the reserve shaft 52 to a high-speed opener roller 58 located below, which is provided with pins 58*b* or sawtooth wire and is in communication at part of its circumference with a lower feed shaft 59. The opener roller 58, which revolves in the direction of arrow 58*a*, conveys the fibre material III that it picks up into the feed shaft 59. The feed shaft 59 has, at its lower end, a take-off roller 60, which revolves according to the arrow shown and which makes the fibre material available to the roller card 51. This roller card feeder 50 can be, for example, a SCANFEED TF 5000 roller card feeder from the company Trützschler, Mönchengladbach. The feed roller 56 rotates slowly in clockwise direction (arrow 56*a*) and the opener roller 58 rotates at high speed in anti-clockwise direction (arrow 58*b*) so that a contrary direction of rotation is brought about. By means of the revolving feed roller 56 and the revolving opener roller 58, a specific amount of fibre material III is continously conveyed per unit time into the feed shaft 59 and an equal amount of fibre material IV is conveyed out from the feed shaft 59 by the take-off roller 60 together with a feed trough 61 and is made available to the roller card 51. The feed device of the roller card 51, comprising the feed roller 60 and feed trough 61, is the same as the take-off device 60, 61 at the lower end of the feed shaft 59. The feed roller 60 and the feed troughs 61 are followed in the work direction A of the roller card 51 by a first preliminary roller 62, a second preliminary roller 63, a preliminary cylinder 64 (licker-in), a transfer roller 65, a main cylinder 66, a doffer 67 and, as roller offtake, a stripper roller 68. Associated with the preliminary cylinder 64 (licker-in) and the main cylinder 66 are two and six, respectively, pairs of rollers, each pair consisting of a worker 71 and clearer 72. Downstream of the stripper roller 68, immediately adjacent thereto and cooperating therewith, are two calendar rollers 73, 74. The directions of rotation of the rollers are indicated by curved arrows. The roller card 51 can, like the roller card feeder 50 arranged upstream thereof, have a width of, for example, 5 m or more. The rollers according to the invention comprising a metal cylinder 35 and a circular cylindrical sheath 36 surrounding the cylinder are used for at least one of rollers 56 and 58 of the roller card feeder 50 and rollers 60 to 74 of the roller card 51.

The flat card feeder 47 shown in FIG. 1 substantially corresponds, in terms of construction and function, to the roller card feeder 50 according to FIG. 9. The flat card feeder 47, like the flat card (FIG. 1), often has a width of 1 m to 1.5 m. The rollers according to the invention are used as rollers for at least one of the intake roller 48 and the high-speed opener roller 49. The metal cylinder of the opener rollers 49 (FIG. 1) and 59 (FIG. 9) can be made of aluminium.

Although the foregoing invention has been described in detail by way of illustration and example for purposes of understanding, it will be obvious that changes and modifications may be practiced within the scope of the appended claims.

What is claimed is:

1. A roller for a fibre-processing machine, having a roller body comprising:

at least one metal cylinder; and at least one sheath of fibre-reinforced plastics material surrounding the cylinder, wherein the sheath comprises at least two groups of reinforcement fibres, each group comprising one or more reinforcement fibres, each said group extending helically at a different pitch from at least one other said group.

2. A roller according to claim 1, wherein the metal cylinder and sheath are mutually biased at room temperature and at operating temperature.

3. A roller according to claim 1, wherein the metal cylinder is subjected to compressive stresses and the sheath is subjected to tensile stresses in the circumferential direction.

4. A roller according to claim 1, wherein the metal cylinder is made, at least in part, of a metal selected from aluminum and steel.

5. A roller according to claim 1, wherein the sheath is made of carbon fibre reinforced plastics material (CFRP).

6. A roller according to claim 1, wherein the thermal expansion coefficient of the carbon fibre reinforced plastics material is adjustable.

7. A roller according to claim 1, in which the sheath is made of glass fibre-reinforced plastics material (GFRP) or of aramid fibre-reinforced plastics material.

8. A roller according to claim 1, wherein the sheath contains reinforcement fibres oriented substantially in a circumferential direction.

9. A roller according to claim 1, in which the sheath contains one or more helically extending reinforcement fibres.

10. A roller according to claim 1, wherein the reinforcement fibres and a matrix material together result in a modulus of elasticity of at least 15000 $N/mm^2$.

11. A roller according to claim 1, wherein the sheath comprises reinforcement fibres that form an included angle of ±75° to 90° with the axial direction of the roller body.

12. A roller according to claim 1, wherein the sheath comprises reinforcement fibres that form an included angle of 35° to 75° with the axial direction of the roller body.

13. A roller according to claim 1, wherein the sheath comprises reinforcement fibres that form an included angle of 1° to 35° with the axial direction of the roller body.

14. A roller for a fibre-processing machine, having a roller body comprising:

at least one metal cylinder;

at least two sheaths of fibre-reinforced plastics material surrounding the cylinder, wherein the at least two sheaths are arranged on top of one another in the radial direction, wherein the at least one sheath has reinforcement fibres extending at a relatively steep angle relative to the axial direction of the roller body and at least one further sheath has reinforcement fibres extending at a relatively shallow included angle relative to the axial direction of the roller body.

15. A roller according to claim 14, wherein the expansion coefficient in the axial direction of at least one sheath is equal to or less than the expansion coefficient in the axial direction of at least one further sheath.

16. A roller according to claim 14, wherein the expansion coefficient in the circumferential direction of at least one sheath is equal to or greater than the expansion coefficient in the circumferential direction of at least one further sheath.

17. A roller according to claim 1, comprising two or more reinforcement fibres arranged next to one another in the circumferential direction.

18. A roller according to claim 1, comprising at least two layers of reinforcement fibres that follow one another in the radial direction, in which the reinforcement fibres in a first layer are so oriented that they cross over the reinforcement fibres of an adjacent layer.

19. A roller according to claim 1, further comprising a clothing.

20. A roller according to claim 19, further comprising means to secure the clothing on the roller.

21. A roller according to claim 1, wherein the roller body has a wall thickness that is uniform over its length.

22. A roller according to claim 1, further comprising end parts, the expansion behaviour of the end parts being matched to the expansion behaviour of the cylindrical part.

23. A roller according to claim 1, wherein the working width of the roller measures more than 1300 mm.

24. A roller according to claim 1, having a roller drive system dimensioned for high speeds of rotation in order to make possible a circumferential speed of at least 40 m/s.

25. A roller according to claim 1, further comprising a clothing having tip density of more than 900 tips per square inch.

26. A roller according to claim 1, wherein the roller is for use in a flat card or roller card as any roller selected from the group consisting of: carding cylinder, feed roller, licker-in, doffer, stripper roller, worker roller and clearer roller.

27. A roller according to claim 1, wherein the roller is suitable for use as an opener roller in an apparatus selected from the group consisting of: flock-feeding apparatus, flock-mixing devices, flock intake devices and bale openers.

28. A roller according to claim 1, which is suitable for use in a drawing mechanism.

29. A roller for a fibre-processing machine, having a roller body comprising:

at least one metal cylinder; and a sheath circumferentially surrounding the metal cylinder, the sheath comprising a matrix material and and at least two groups of reinforcement fibres, each group comprising one or more reinforcement fibres, each said group extending helically at a different pitch from at least one other said group.

30. A roller according to claim 29, in which at least the matrix material of said sheath is a plastics material.

* * * * *

UNITED STATES PATENT AND TRADEMARK OFFICE

CERTIFICATE OF CORRECTION

PATENT NO. : 7,578,033 B2
APPLICATION NO. : 11/176376
DATED : August 25, 2009
INVENTOR(S) : Schlichter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1078 days.

Signed and Sealed this

Seventh Day of September, 2010

David J. Kappos

David J. Kappos
*Director of the United States Patent and Trademark Office*